US007066055B1

(12) United States Patent
Lee

(10) Patent No.: US 7,066,055 B1
(45) Date of Patent: Jun. 27, 2006

(54) RATCHET WRENCH THAT CAN RELEASE SOCKET RAPIDLY

(76) Inventor: Yi-Min Lee, No.62, Renmei Rd., Dali City, Taichung County (TW) 412

( * ) Notice: Subject to any disclaimer, the term of this patent is extended or adjusted under 35 U.S.C. 154(b) by 0 days.

(21) Appl. No.: 11/028,438

(22) Filed: Dec. 30, 2004

(51) Int. Cl.
*B25B 13/46* (2006.01)

(52) U.S. Cl. ..... 81/63; 81/177.85

(58) Field of Classification Search ..... 81/60–63.2, 81/177.85, 58, 58.4, 59.1
See application file for complete search history.

(56) References Cited

U.S. PATENT DOCUMENTS 3,393,587 A * 7/1968 Jolliff et al. ..... 81/63.2
3,532,013 A * 10/1970 Haznar ..... 81/62
4,211,127 A * 7/1980 D'Oporto et al. ..... 81/63
4,297,924 A * 11/1981 Stephens ..... 81/59.1
4,307,632 A * 12/1981 Penner ..... 81/63
4,317,392 A * 3/1982 Stephens et al. ..... 81/63.1
4,520,697 A * 6/1985 Moetteli ..... 81/62
4,524,653 A * 6/1985 Konecny ..... 81/63
4,762,033 A * 8/1988 Chow ..... 81/63.2
5,916,339 A * 6/1999 Dumont ..... 81/63.1
5,960,680 A * 10/1999 Chen et al. ..... 81/63.2
6,601,476 B1 * 8/2003 Hu ..... 81/60
6,712,484 B1 * 3/2004 Hsien ..... 362/119
6,748,824 B1 * 6/2004 Chen ..... 81/60
6,766,716 B1 * 7/2004 Lee ..... 81/60

* cited by examiner

*Primary Examiner*—David B. Thomas
(74) *Attorney, Agent, or Firm*—Charles E. Baxley

(57) ABSTRACT

A ratchet wrench includes a wrench body, a ratchet wheel, a direction control mechanism, a drive member, a ball, and a quick release mechanism. The quick release mechanism includes a bolt, a movable rod, a press knob, and an elastic member. Thus, the socket is mounted on and detached from the driving head of the drive member easily and rapidly, thereby facilitating a user mounting the socket on the driving head of the drive member and detaching the socket from the driving head of the drive member.

17 Claims, 6 Drawing Sheets

RATCHET WRENCH THAT CAN RELEASE SOCKET RAPIDLY

BACKGROUND OF THE INVENTION

1. Field of the Invention

The present invention relates to a ratchet wrench, and more particularly to a ratchet wrench that can release a socket easily and rapidly.

2. Description of the Related Art

A conventional ratchet wrench in accordance with the prior art shown in FIG. 6 comprises a wrench body 81 having a handle 80, a ratchet wheel (not shown) mounted in the wrench body 81, a direction control mechanism 82 mounted on a first side of the wrench body 81 and engaged with the ratchet wheel to control an operation direction of the ratchet wheel, a drive member 83 having a first portion mounted on a second side of the wrench body 81 and a second portion provided with a square driving head 84 for mounting a socket (not shown), and a ball 85 movably mounted on the driving head 84 of the drive member 83 and pressed on the socket to lock the socket on the driving head 84 of the drive member 83. However, a user has to exert a force on the socket and the wrench body 81 to detach the socket from the driving head 84 of the drive member 83, so that the socket cannot be detached from the driving head 84 of the drive member 83 easily and rapidly, thereby greatly causing inconvenience to the user.

SUMMARY OF THE INVENTION

The primary objective of the present invention is to provide a ratchet wrench that can release a socket easily and rapidly.

Another objective of the present invention is to provide a ratchet wrench, wherein the socket is mounted on and detached from the driving head of the drive member easily and rapidly, thereby facilitating a user mounting the socket on the driving head of the drive member and detaching the socket from the driving head of the drive member.

A further objective of the present invention is to provide a ratchet wrench, wherein the socket is mounted on and detached from the driving head of the drive member by pressing the press knob, thereby facilitating the user operating the drive member to rotate the socket.

A further objective of the present invention is to provide a ratchet wrench, wherein the user only needs to press the press knob by his one finger without needing co-operation of his two hands, thereby facilitating the user operating the ratchet wrench.

In accordance with the present invention, there is provided a ratchet wrench, comprising:

a wrench body;

a ratchet wheel mounted in the wrench body;

a direction control mechanism mounted on a first side of the wrench body and engaged with the ratchet wheel to control an operation direction of the ratchet wheel;

a drive member having a first portion mounted on a second side of the wrench body and a second portion provided with a driving head for mounting a socket;

a ball movably mounted on the driving head of the drive member and pressed on the socket;

a quick release mechanism mounted in the wrench body and operable to press the ball on the socket to lock the socket on the driving head of the drive member and to release the ball from the socket to unlock the socket from the driving head of the drive member.

Further benefits and advantages of the present invention will become apparent after a careful reading of the detailed description with appropriate reference to the accompanying drawings.

DETAILED DESCRIPTION OF THE INVENTION

Figure 1:
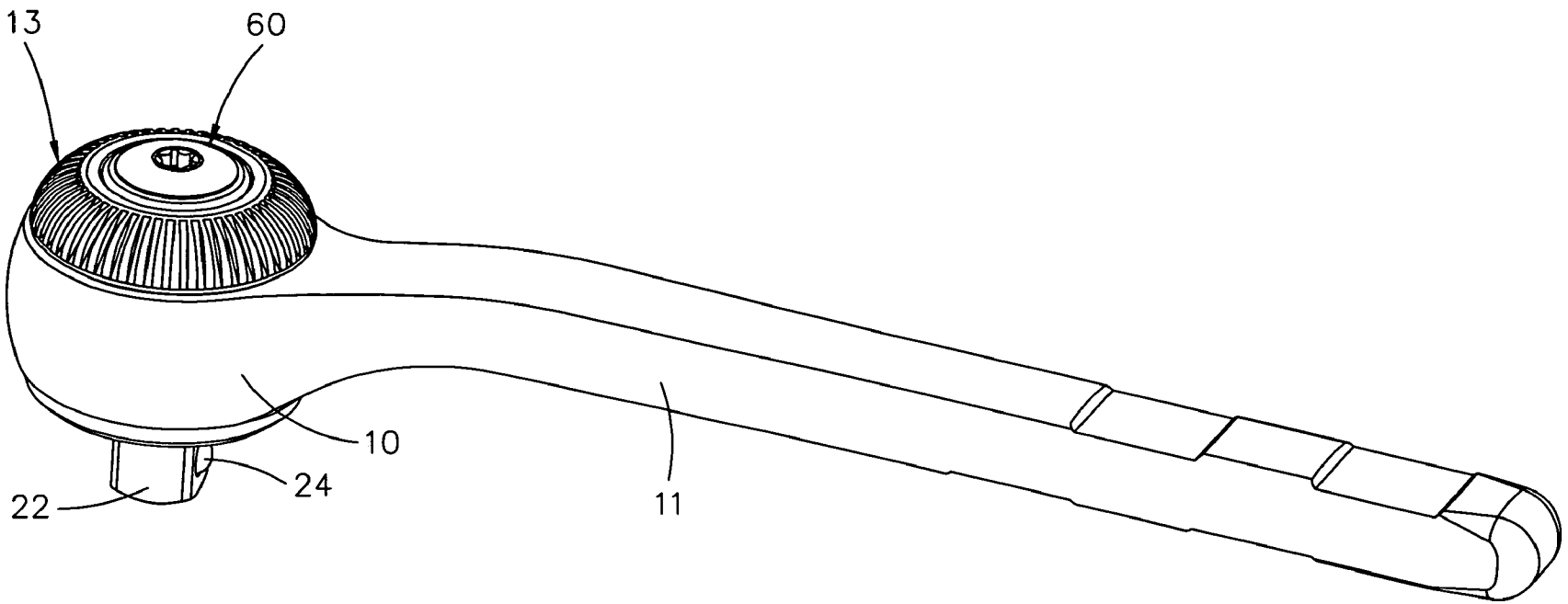
FIG. 1 is a perspective view of a ratchet wrench in accordance with the preferred embodiment of the present invention.
Figure 2:
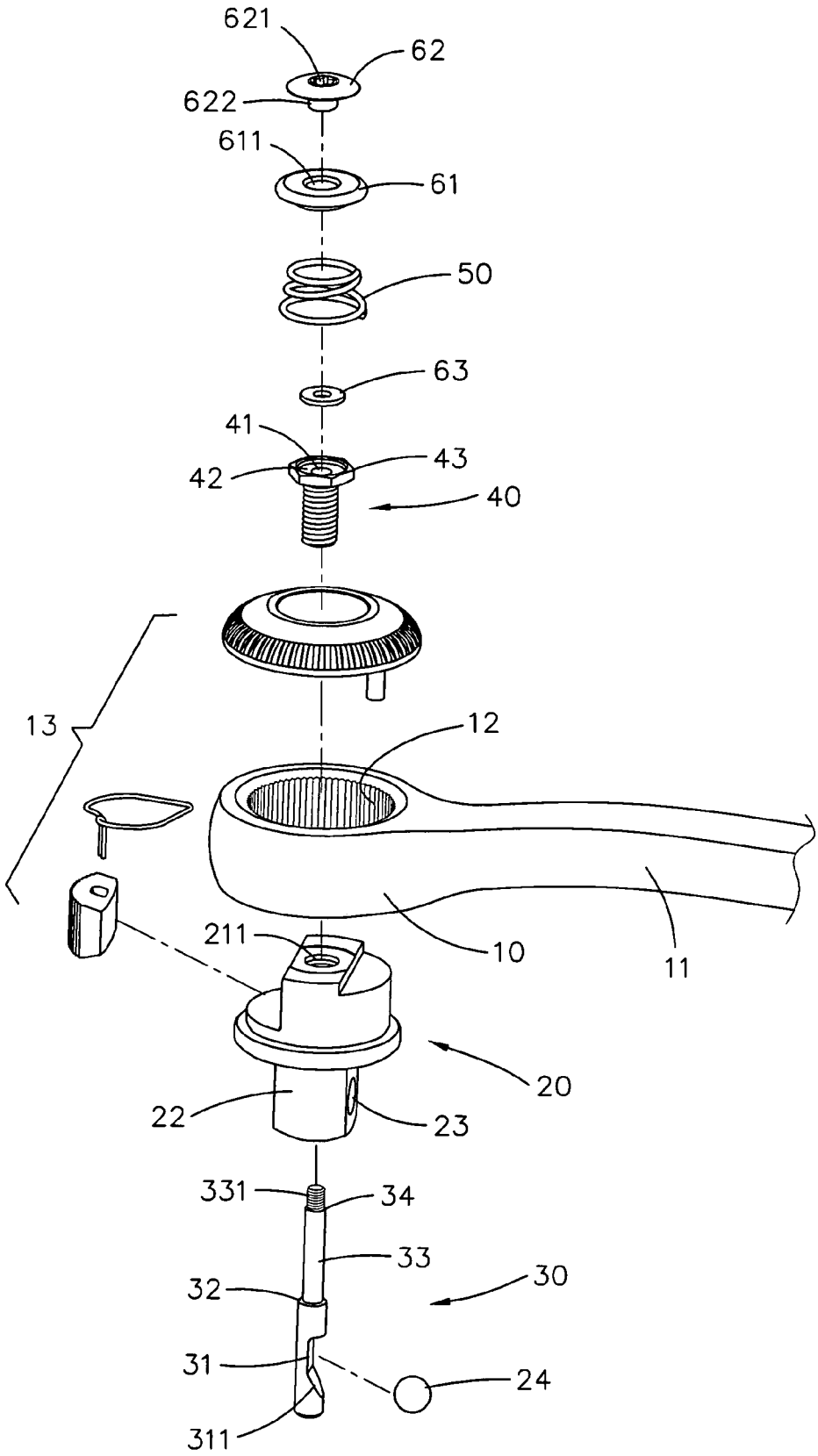
FIG. 2 is a partially cut-away exploded perspective view of the ratchet wrench as shown in FIG. 1.
Figure 3:
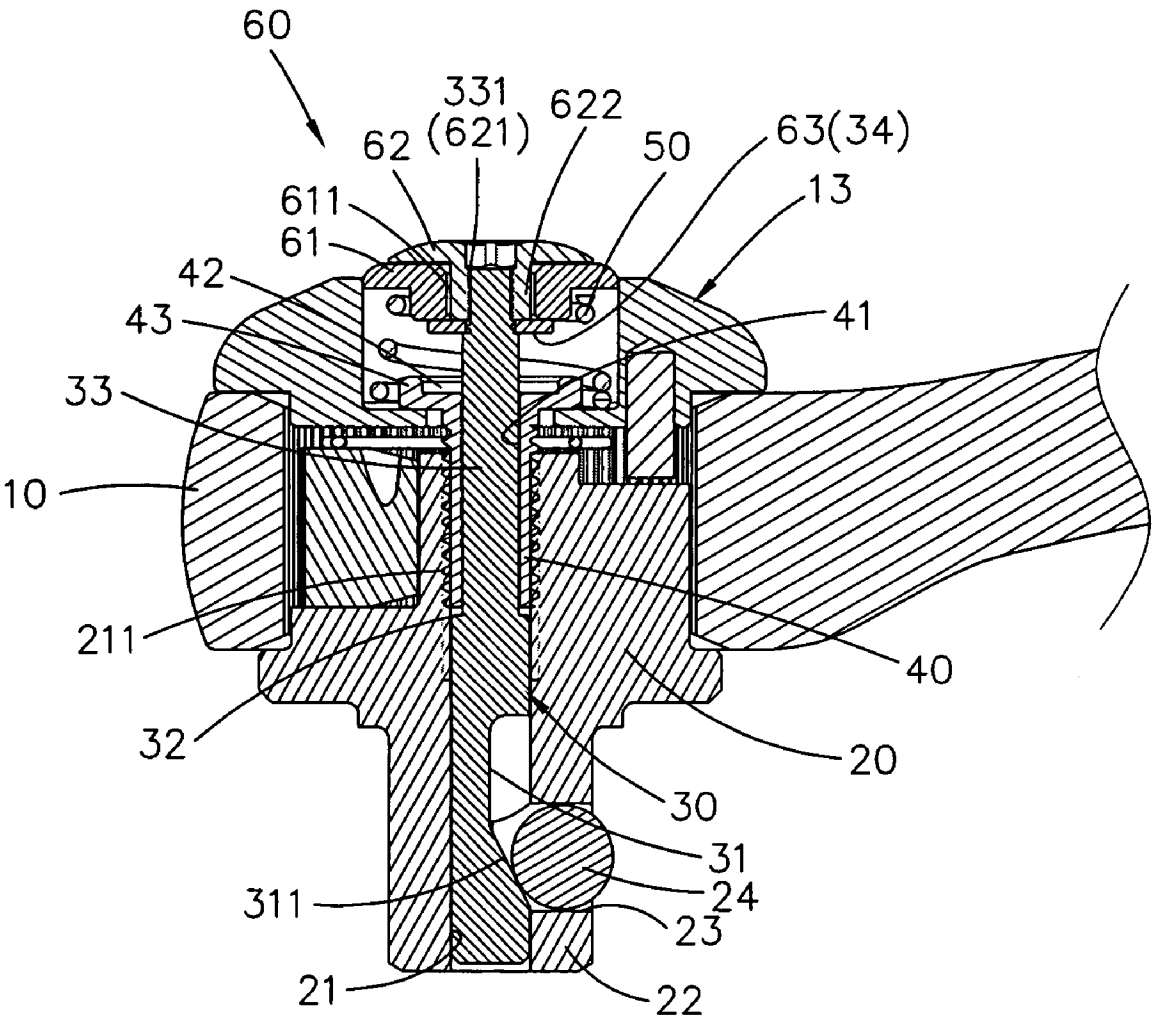
FIG. 3 is a partially cut-away plan cross-sectional view of the ratchet wrench as shown in FIG. 1.

Referring to the drawings and initially to FIGS. 1–3, a ratchet wrench in accordance with the preferred embodiment of the present invention comprises a wrench body 10 having a handle 11, a ratchet wheel 12 mounted in the wrench body 10, a direction control mechanism 13 mounted on a first side of the wrench body 10 and engaged with the ratchet wheel 12 to control an operation direction of the ratchet wheel 12, a drive member 20 having a first portion mounted on a second side of the wrench body 10 and a second portion provided with a square driving head 22 for mounting a socket 70 (see FIG. 4), a ball 24 movably mounted on the driving head 22 of the drive member 20 and pressed on the socket 70, and a quick release mechanism mounted in the wrench body 10 and operable to press the ball 24 on the socket 70 to lock the socket 70 on the driving head 22 of the drive member 20 and to release the ball 24 from the socket 70 to unlock the socket 70 from the driving head 22 of the drive member 20.

The quick release mechanism is operable in a pressing manner to control movement of the ball 24, so that the ball 24 is moved rapidly.

The quick release mechanism includes a bolt 40 mounted between the drive member 20 and the direction control mechanism 13, a movable rod 30 movably mounted in the drive member 20 and having a first end formed with a recess 31 to retractably receive the ball 24 and a second end provided with a reduced shaft 33 movably mounted in and protruded outward from the bolt 40, a press knob 60 secured on the shaft 33 of the movable rod 30 to press the movable rod 30 to move in the drive member 20, and an elastic member 50 mounted on the shaft 33 of the movable rod 30 and biased between the wrench body 10 and the press knob 60 to push the press knob 60 and the shaft 33 of the movable rod 30 to move outward relative to the drive member 20. Preferably, the elastic member 50 has a first end pressed on the direction control mechanism 13 of the wrench body 10 and a second end pressed on the press knob 60.

The drive member 20 has an inside formed with an axially extended through hole 21 to receive the movable rod 30. The first portion of the drive member 20 is formed with a screw bore 211 connected to the through hole 21. The driving head 22 of the drive member 20 has a side formed with a ball hole 23 connected to the through hole 21 to retractably receive the ball 24.

The bolt 40 is secured on the first portion of the drive member 20 and rested on the direction control mechanism 13. The bolt 40 is screwed into the screw bore 211 of the drive member 20 and has a bolt head 43 rested on the direction control mechanism 13 to combine the drive member 20 with the direction control mechanism 13 so that the drive member 20 and the direction control mechanism 13 will not detach from the wrench body 10. The bolt 40 has an inside formed with an axially extended through bore 41 to receive the shaft 33 of the movable rod 30. The bolt head 43 of the bolt 40 is formed with a depression 42.

The movable rod 30 has a mediate portion formed with an annular shoulder 32 that is movable to abut a distal end of the bolt 40 to limit a further movement of the shaft 33 of the movable rod 30 in the through bore 41 of the bolt 40. The recess 31 of the movable rod 30 has a distal end formed with a tapered pressing face 311 that is movable by an elastic force of the elastic member 50 to press the ball 24 to protrude outward from the driving head 22 of the drive member 20. The tapered pressing face 311 of the movable rod 30 has a thickness gradually increased outward from the distal end of the recess 31. The shaft 33 of the movable rod 30 has a distal end formed with an outer thread 331 protruded outward from the bolt 40. The outer thread 331 of the movable rod 30 has a diameter smaller than that of the shaft 33 of the movable rod 30. The distal end of the shaft 33 of the movable rod 30 is formed with a stop edge 34 located at a root portion of the outer thread 331.

The press knob 60 includes a fixing seat 62 secured on the shaft 33 of the movable rod 30, a washer 63 mounted on the shaft 33 of the movable rod 30 and rested on the stop edge 34 of the shaft 33 of the movable rod 30, and an urging seat 61 mounted between the fixing seat 62 and the washer 63 and pressed on the second end of the elastic member 50. The fixing seat 62 has a substantially T-shaped cross-section profile and has an inside formed with a screw hole 621 screwed onto the outer thread 331 of the shaft 33 of the movable rod 30. The fixing seat 62 has a side formed with a protruding stub 622 rested on the washer 63. The urging seat 61 is a hollow disk and has an inside formed with a mounting hole 611 mounted on the protruding stub 622 of the fixing seat 62. The washer 63 is movable with the shaft 33 of the movable rod 30 to be inserted into the depression 42 of the bolt 40, thereby retaining the press knob 60 on the bolt 40.

In operation, as shown in FIGS. 1–3, the press knob 60 and the movable rod 30 are moved upward relative to the drive member 20 by the elastic force of the elastic member 50, so that the tapered pressing face 311 of the movable rod 30 is moved upward to press the ball 24 to protrude outward from the ball hole 23 of the driving head 22 of the drive member 20.

Figure 4:
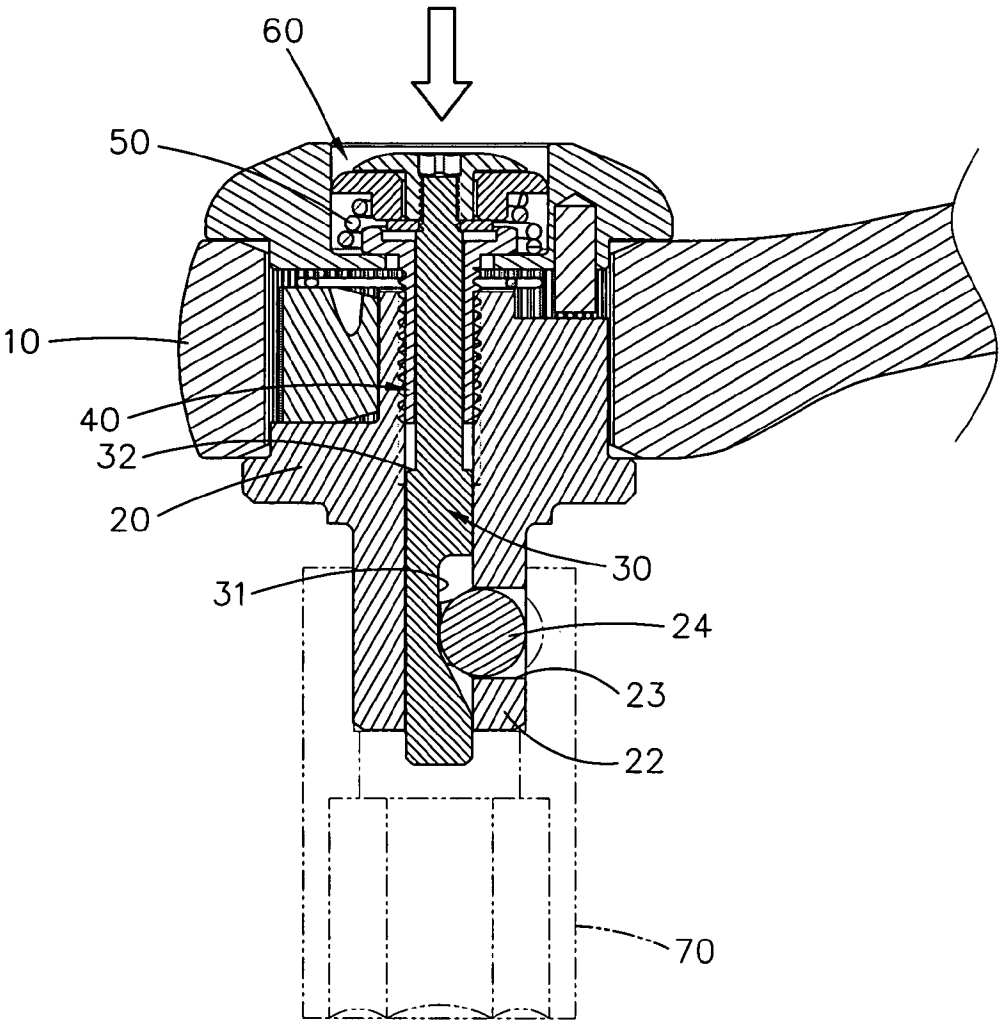
FIG. 4 is a schematic operational view of the ratchet wrench as shown in FIG. 3.

As shown in FIG. 4, when the press knob 60 is pressed downward relative to the drive member 20 to overcome the elastic force of the elastic member 50, the movable rod 30 is moved downward by the press knob 60 until the recess 31 of the movable rod 30 aligns with the ball hole 23 of the driving head 22 of the drive member 20, so that the ball 24 is entirely retracted into the ball hole 23 of the driving head 22 of the drive member 20 and received in the recess 31 of the movable rod 30. Thus, the socket 70 is mounted on and detached from the driving head 22 of the drive member 20 easily and rapidly, thereby facilitating a user mounting the socket 70 on the driving head 22 of the drive member 20 and detaching the socket 70 from the driving head 22 of the drive member 20.

Figure 5:
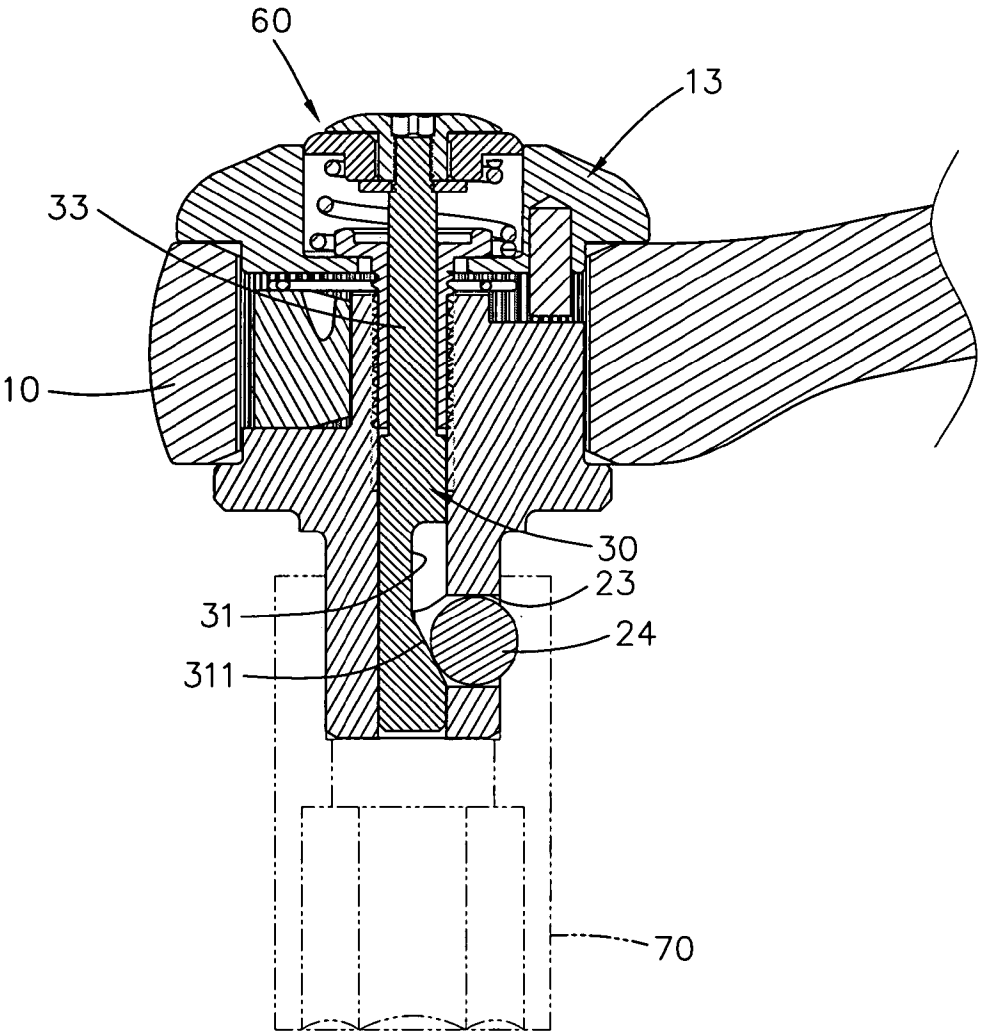
FIG. 5 is a schematic operational view of the ratchet wrench as shown in FIG. 4.
Figure 6:
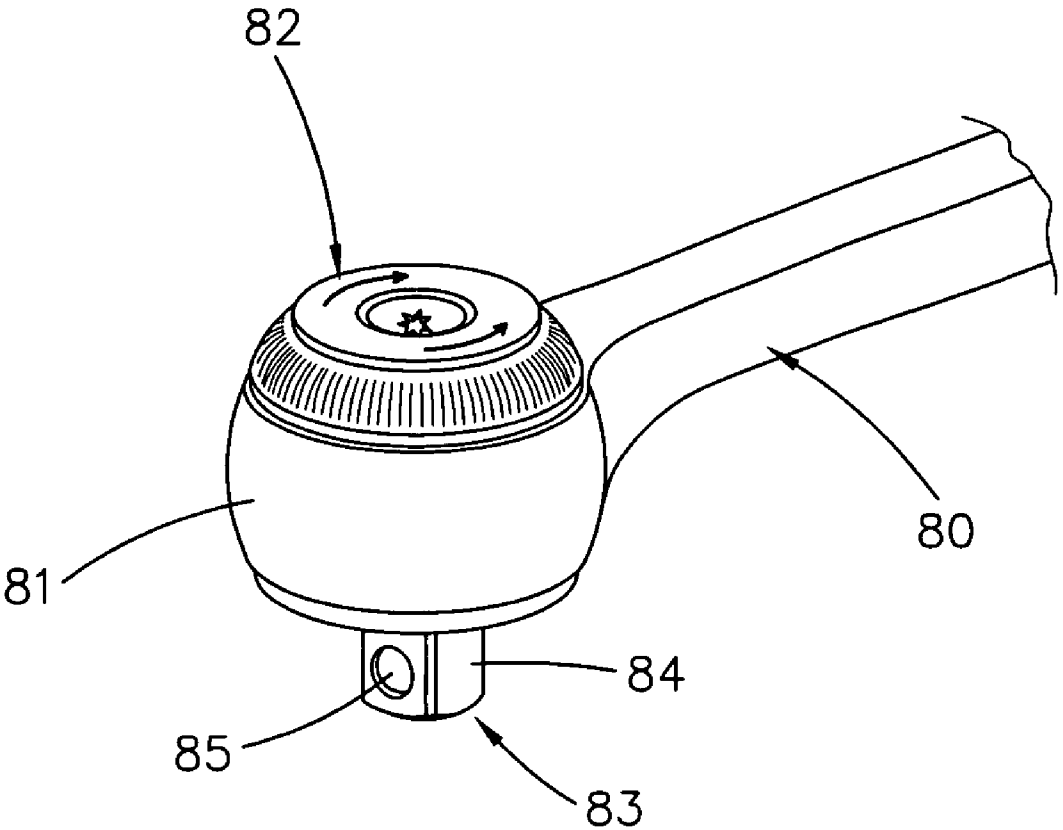
FIG. 6 PRIOR ART
FIG. 6 is a partially cut-away exploded perspective view of a conventional ratchet wrench in accordance with the prior art.

As shown in FIG. 5, after the pressing force applied on the press knob 60 is removed, the press knob 60 and the movable rod 30 are moved upward relative to the drive member 20 by the restoring force of the elastic member 50, so that the tapered pressing face 311 of the movable rod 30 is moved upward to press the ball 24 to protrude outward from the ball hole 23 of the driving head 22 of the drive member 20 so as to press the socket 70, thereby retaining the socket 70 on the driving head 22 of the drive member 20.

Accordingly, the socket 70 is mounted on and detached from the driving head 22 of the drive member 20 easily and rapidly, thereby facilitating a user mounting the socket 70 on the driving head 22 of the drive member 20 and detaching the socket 70 from the driving head 22 of the drive member 20. In addition, the socket 70 is mounted on and detached from the driving head 22 of the drive member 20 by pressing the press knob 60, thereby facilitating the user operating the drive member 20 to rotate the socket 70. Further, the user only needs to press the press knob 60 by his one finger without needing co-operation of his two hands, thereby facilitating the user operating the ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising:

a wrench body;

a ratchet wheel mounted in the wrench body;

a direction control mechanism mounted on a first side of the wrench body and engaged with the ratchet wheel to control an operation direction of the ratchet wheel;

a drive member having a first portion mounted on a second side of the wrench body and a second portion provided with a driving head for mounting a socket;

a ball movably mounted on the driving head of the drive member and pressed on the socket;

a quick release mechanism mounted in the wrench body and operable to press the ball on the socket to lock the socket on the driving head of the drive member and to release the ball from the socket to unlock the socket from the driving head of the drive member; wherein the quick release mechanism includes:

a bolt mounted between the drive member and the direction control mechanism;

a movable rod movably mounted in the drive member and having a first end formed with a recess to retractably receive the ball and a second end provided with a shaft movably mounted in and protruded outward from the bolt;

a press knob secured on the shaft of the movable rod to press the movable rod to move in the drive member;

an elastic member mounted on the shaft of the movable rod and biased between the wrench body and the press knob;

the bolt has an inside formed with an axially extended through bore to receive the shaft of the movable rod;

the movable rod has a mediate portion formed with an annular shoulder that is movable to abut a distal end of the bolt to limit a further movement of the shaft of the movable rod in the through bore of the bolt.

2. The ratchet wrench in accordance with claim 1, wherein the quick release mechanism is operable in a pressing manner to control movement of the ball.

3. The ratchet wrench in accordance with claim 1, wherein the elastic member pushes the press knob and the shaft of the movable rod to move outward relative to the drive member.

4. The ratchet wrench in accordance with claim 1, wherein the elastic member has a first end pressed on the direction control mechanism of the wrench body and a second end pressed on the press knob.

5. The ratchet wrench in accordance with claim 1, wherein the drive member has an inside formed with an axially extended through hole to receive the movable rod.

6. The ratchet wrench in accordance with claim 5, wherein the first portion of the drive member is formed with a screw bore connected to the through hole, and the bolt is screwed into the screw bore of the drive member.

7. The ratchet wrench in accordance with claim 5, wherein the driving head of the drive member has a side formed with a ball hole connected to the through hole to retractably receive the ball.

8. The ratchet wrench in accordance with claim 1, wherein the bolt is secured on the first portion of the drive member and rested on the direction control mechanism.

9. The ratchet wrench in accordance with claim 1, wherein the bolt has a bolt head rested on the direction control mechanism to combine the drive member with the direction control mechanism so that the drive member and the direction control mechanism will not detach from the wrench body.

10. The ratchet wrench in accordance with claim 1, wherein the recess of the movable rod has a distal end formed with a tapered pressing face that is movable by an elastic force of the elastic member to press the ball to protrude outward from the driving head of the drive member.

11. The ratchet wrench in accordance with claim 10, wherein the tapered pressing face of the movable rod has a thickness gradually increased outward from the distal end of the recess.

12. A ratchet wrench, comprising:

a wrench body;

a ratchet wheel mounted in the wrench body;

a direction control mechanism mounted on a first side of the wrench body and engaged with the ratchet wheel to control an operation direction of the ratchet wheel;

a drive member having a first portion mounted on a second side of the wrench body and a second portion provided with a driving head for mounting a socket;

a ball movably mounted on the driving head of the drive member and pressed on the socket;

a quick release mechanism mounted in the wrench body and operable to press the ball on the socket to lock the socket on the driving head of the drive member and to release the ball from the socket to unlock the socket from the driving head of the drive member; wherein the quick release mechanism includes:

a bolt mounted between the drive member and the direction control mechanism;

a movable rod movably mounted in the drive member and having a first end formed with a recess to retractably receive the ball and a second end provided with a shaft movably mounted in and protruded outward from the bolt;

a press knob secured on the shaft of the movable rod to press the movable rod to move in the drive member;

an elastic member mounted on the shaft of the movable rod and biased between the wrench body and the press knob;

the press knob includes a fixing seat secured on the shaft of the movable rod, a washer mounted on the shaft of the movable rod, and an urging seat mounted between the fixing seat and the washer and pressed on the second end of the elastic member.

13. The ratchet wrench in accordance with claim 12, wherein the bolt has an end formed with a depression, and the washer is movable with the shaft of the movable rod to be inserted into the depression of the bolt, thereby retaining the press knob on the bolt.

14. The ratchet wrench in accordance with claim 12, wherein the shaft of the movable rod has a distal end formed with an outer thread protruded outward from the bolt, and the fixing seat has an inside formed with a screw hole screwed onto the outer thread of the shaft of the movable rod.

15. The ratchet wrench in accordance with claim 14, wherein the distal end of the shaft of the movable rod is formed with a stop edge located at a root portion of the outer thread, and the washer is rested on the stop edge of the shaft of the movable rod.

16. The ratchet wrench in accordance with claim 12, wherein the fixing seat has a side formed with a protruding stub rested on the washer, and the urging seat has an inside formed with a mounting hole mounted on the protruding stub of the fixing seat.

17. The ratchet wrench in accordance with claim 12, wherein the fixing seat has a substantially T-shaped cross-section profile.

* * * * *